US006527373B1

(12) United States Patent
Delametter et al.

(10) Patent No.: US 6,527,373 B1
(45) Date of Patent: Mar. 4, 2003

(54) DROP-ON-DEMAND LIQUID EMISSION USING INTERCONNECTED DUAL ELECTRODES AS EJECTION DEVICE

(75) Inventors: Christopher N. Delametter, Rochester, NY (US); Edward P. Furlani, Lancaster, NY (US); Michael J. Debar, Rochester, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/122,566

(22) Filed: Apr. 15, 2002

(51) Int. Cl.[7] ..... B41J 2/04
(52) U.S. Cl. ..... 347/54
(58) Field of Search ..... 347/54, 68, 70, 347/71, 72, 50, 40, 20, 44, 47, 27, 63; 399/261, 700; 310/328–330; 29/890.1

(56) References Cited

U.S. PATENT DOCUMENTS 4,520,375 A 5/1985 Kroll
5,644,341 A 7/1997 Fujii et al.
5,668,579 A 9/1997 Fujii et al.
5,739,831 A 4/1998 Nakamura et al.
6,127,198 A 10/2000 Coleman et al.
6,318,841 B1 11/2001 Coleman et al.
2001/0023523 A1 9/2001 Kubby et al.

*Primary Examiner*—Raquel Yvette Gordon
(74) *Attorney, Agent, or Firm*—Milton S. Sales

(57) ABSTRACT

A liquid emission device includes a chamber having a nozzle orifice. Separately addressable dual electrodes are positioned on opposite sides of a ground electrode. The three electrodes are aligned with the nozzle orifice. A rigid electrically insulating coupler connects the two addressable electrodes. To eject a drop, an electrostatic charge is applied to the addressable electrode nearest to the nozzle orifice, which pulls that electrode away from the orifice, drawing liquid into the expanding chamber. The other addressable electrode moves in conjunction, storing potential energy in the system. Subsequently the addressable electrode nearest to the nozzle is de-energized and the other addressable electrode is energized, causing the other electrode to be pulled toward the ground electrode in conjunction with the release of the stored elastic potential energy. This action pressurizes the liquid in the chamber behind the nozzle orifice, causing a drop to be ejected from the nozzle orifice.

21 Claims, 6 Drawing Sheets

DROP-ON-DEMAND LIQUID EMISSION USING INTERCONNECTED DUAL ELECTRODES AS EJECTION DEVICE

FIELD OF THE INVENTION

The present invention relates generally to drop-on-demand liquid emission devices such as, for example, ink jet printers, and more particularly such devices which employ an electrostatic actuator for driving liquid from the device.

BACKGROUND OF THE INVENTION

Drop-on-demand (DOD) liquid emission devices with electrostatic actuators are known for ink printing systems. U.S. Pat. Nos. 5,644,341 and 5,668,579, which issued to Fujii et al. on Jul. 1, 1997 and Sep. 16, 1997, respectively, disclose such devices having electrostatic actuators composed of a diaphragm and opposed electrode. The diaphragm is distorted by application of a first voltage to the electrode. Relaxation of the diaphragm expels an ink droplet from the device. Other devices that operate on the principle of electrostatic attraction are disclosed in U.S. Pat. Nos. 5,739,831, 6,127,198, and 6,318,841; and in U.S. Pub. No. 2001/0023523.

According to the prior art, an electrostatic attraction force is applied in a single direction, as the electrodes can only attract; repulsion being impossible. Thus, the devices must rely on the elastic memory of the diaphragm to return to an at-rest position. In order to produce sufficient force, large electrodes are required, and the gap between electrodes needs to be small. These two criteria are difficult to achieve while still providing for sufficient displacement to expel a reasonably sized droplet. Another drawback of large electrodes is the poor spatial resolution between nozzles.

Devices that rely on the elastic memory of the diaphragm to expel liquid drops exhibit a reduction on the force over the time that liquid is being expelled. That is, the speed at which the diaphragm moves as it approached its at-rest position decreases. The result is a tendency toward the production of undesirable satellite droplets accompanying the main drop.

SUMMARY OF THE INVENTION

According to a feature of the present invention, a drop-on-demand liquid emission device, such as for example an inkjet printer, includes an electrostatic drop ejection mechanism that employs an electric field for driving liquid from the device. Structurally coupled, separately addressable dual electrodes greatly enhance the fundamental efficiency of the electrostatic drop ejection mechanism. The increased efficiency of the electrostatic drop ejection mechanism enables a reduction of electrode size (area) and reduces the required electrode voltage.

The liquid emission device includes a liquid chamber having a nozzle orifice. Separately addressable dual electrodes are positioned on opposite sides of a single ground electrode such that the three electrodes are generally axially aligned with the nozzle orifice. The ground electrode is structurally stiff, and the two addressable electrodes are structurally connected via a rigid, electrically insulating coupler. To eject a drop, an electrostatic charge is applied to the addressable electrode nearest to the nozzle orifice, which pulls that electrode toward the ground electrode and away from the orifice. This electrode forms a wall portion of the liquid chamber behind the nozzle orifice, so that movement of this electrode away from the nozzle expands the chamber, drawing liquid into the expanding chamber. The other addressable electrode moves in conjunction, storing elastic potential energy in the system. Subsequently the addressable electrode nearest to the nozzle is de-energized and the other addressable electrode is energized, causing the other electrode to be pulled toward the ground electrode in conjunction with the release of the stored elastic potential energy. This action pressurizes the liquid in the chamber behind the nozzle orifice, causing a drop to be ejected from the nozzle orifice.

There are several advantages associated with the present invention. The efficiency of the electrostatic drop ejection mechanism will be increased. The force applied during the final stages of drop ejection and separation will be positive and controllable such that the risk of satellite formation is substantially reduced. Since there is no electric field across the ink, conductive inks and other liquids can be used. Also, the electric field can be across air or other dielectric fluid, enhancing the electrostatic performance of the system.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides an apparatus and method of operating a drop-on-demand liquid emission device. The most familiar of such devices are used as printheads in ink jet printing systems. Many other applications are emerging which make use of devices similar to ink jet printheads, but which emit liquids (other than inks) that need to be finely metered and deposited with high spatial precision. The inventions described below provide apparatus and methods for operating drop emitters based on electrostatic actuators so as to improve energy efficiency and overall drop emission productivity.

Figure 1:
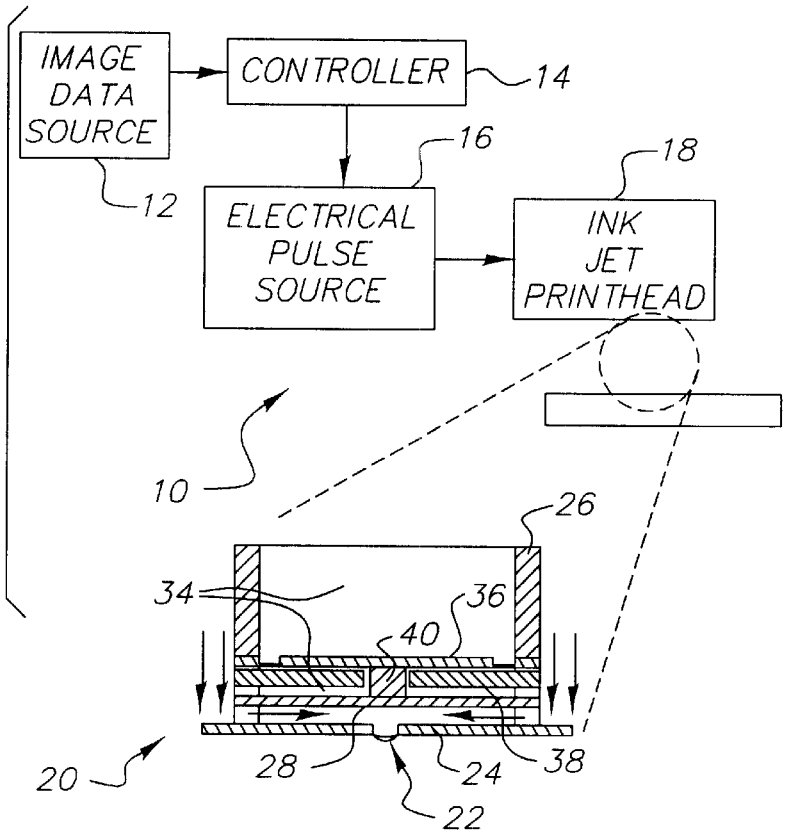
FIG. 1 is a schematic illustration of a drop-on-demand liquid emission device according to the present invention.

FIG. 1 shows a schematic representation of a drop-on-demand liquid emission device 10, such as an ink jet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an ink jet printer 18.

Drop-on-demand liquid emission device 10 includes a plurality of electrostatic drop ejection mechanisms 20. FIG.

2 is a cross-sectional view of one of the plurality of electrostatically actuated drop ejection mechanisms 20. A nozzle orifice 22 is formed in a nozzle plate 24 for each mechanism 20. A wall or walls 26 that carry an electrically addressable electrode 28 bound each drop ejection mechanism 20. The outer periphery of electrode 28 is sealingly attached to wall 26 to define a liquid chamber 30 adapted to receive the liquid, such as for example ink, to be ejected from nozzle orifice 22. The liquid is drawn into chamber 30 through one or more ports 32 from a supply, not shown. Ports 32 are sized as discussed below. Dielectric fluid fills the region 34 on the side of electrode 28 opposed to chamber 30. The dielectric fluid is preferably air or other dielectric gas, although a dielectric liquid may be used.

A second electrode 36 is electrically addressable separately from electrode 28. Addressable electrodes 28 and 36 are preferably at least partially flexible and are positioned on opposite sides of a single ground electrode 38 such that the three electrodes are generally axially aligned with nozzle orifice 22. Addressable electrode 36 is illustrated with a peripheral region that has enhanced flexibility. Since there is no need for addressable electrode to completely seal with wall 26, the peripheral region may by mere tabs tethering the central region of electrode 36 to wall 26.

Ground electrode 38 is structurally stiff, and the two addressable electrodes are structurally connected via a rigid coupler 40. This coupler is electrically insulating, which term is intended to include a coupler of conductive material but having a non-conductive break therein. Coupler 40 ties the two addressable electrodes structurally together and insolates the electrodes so as to make possible distinct charges on the two.

Figure 5:
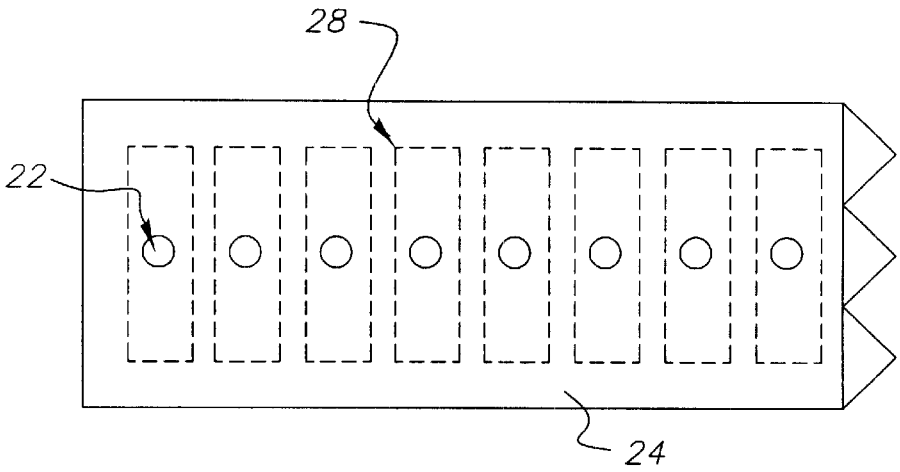
FIGS. 3–5 are top plan views of alternative embodiments of a nozzle plate of the drop-on-demand liquid emission device of FIGS. 1 and 2.
Figure 2:
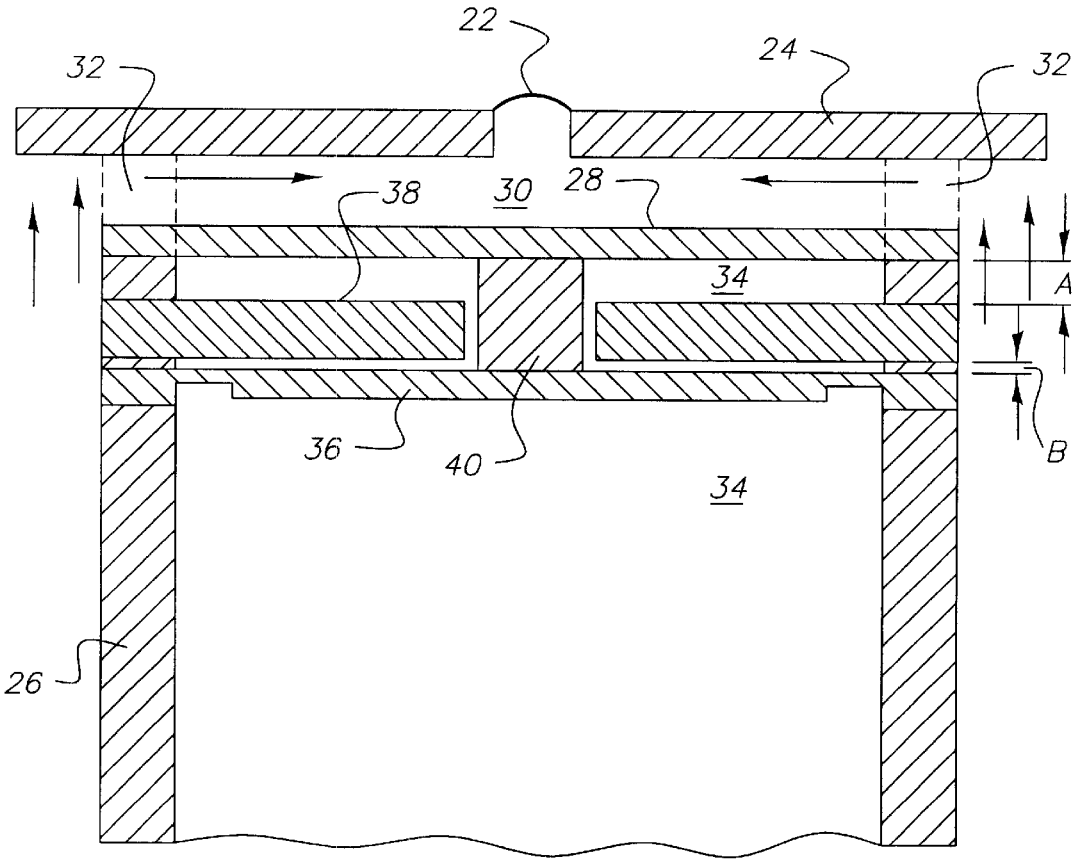
FIG. 2 is a cross-sectional view of a portion of drop-on-demand liquid emission device of FIG. 1.
Figure 3:
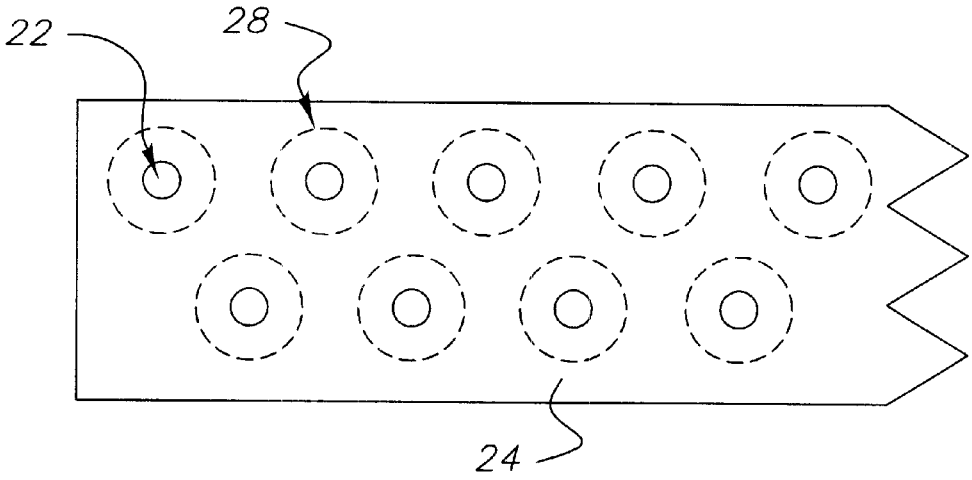
Figure 4:
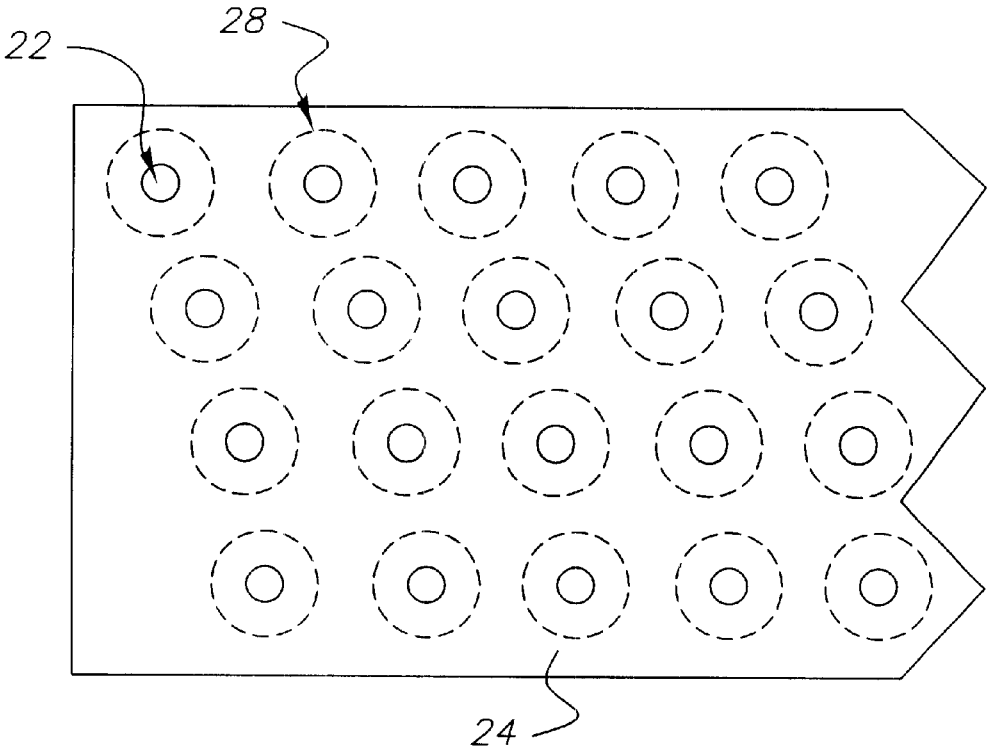

FIGS. 3–5 are top plan views of nozzle plate 24, showing several alternative embodiments of layout patterns for the several nozzle orifices 22 of a print head. Note that in FIGS. 2 and 3, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

Figure 6:
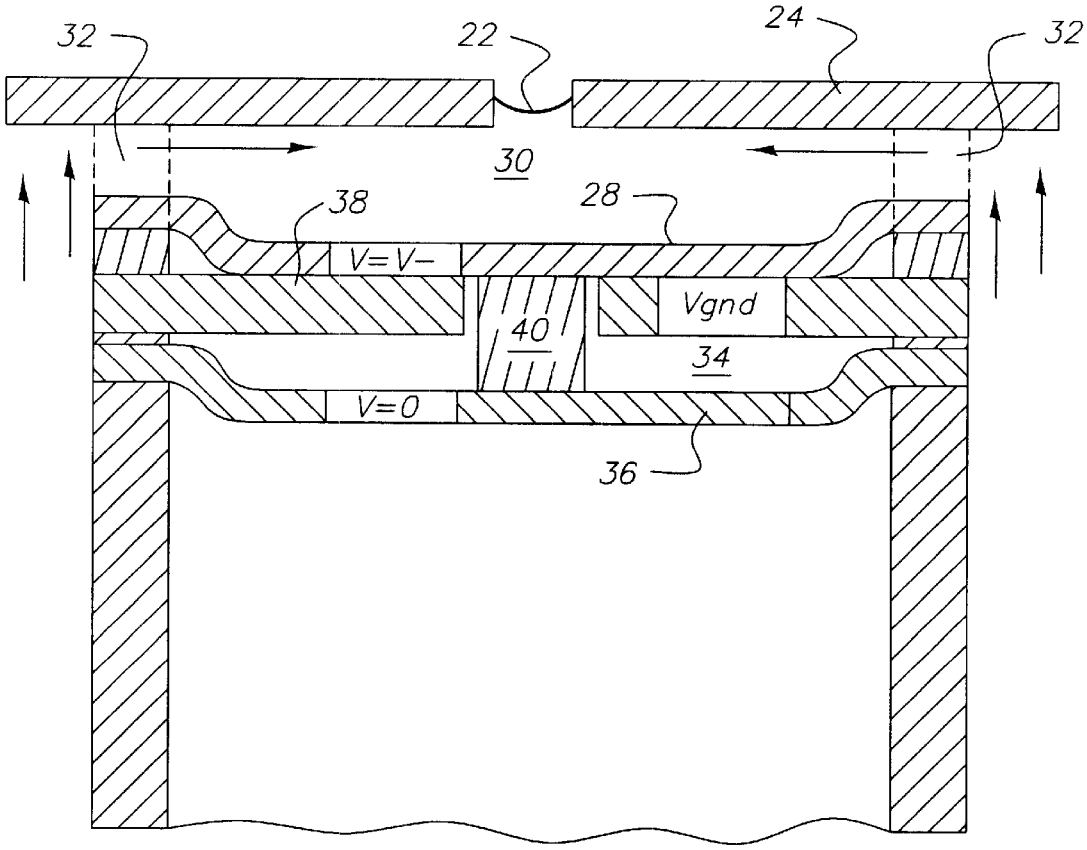
FIG. 6 is a cross-sectional view of the drop-on-demand liquid emission device of FIG. 2 shown in a first actuation stage.

Referring to FIG. 6, to eject a drop, an electrostatic charge is applied to the addressable electrode 28 nearest to nozzle orifice 22, which pulls that electrode toward ground electrode 38 and away from the nozzle orifice. Since this electrode forms a wall portion of liquid chamber 30 behind the nozzle orifice, movement of electrode 28 away from nozzle plate 24 expands the chamber, drawing liquid into the expanding chamber through ports 32. Addressable electrode 36 does not receive an electrostatic charge, and moves in conjunction with addressable electrode 28, storing elastic potential energy in the system.

Figure 7:
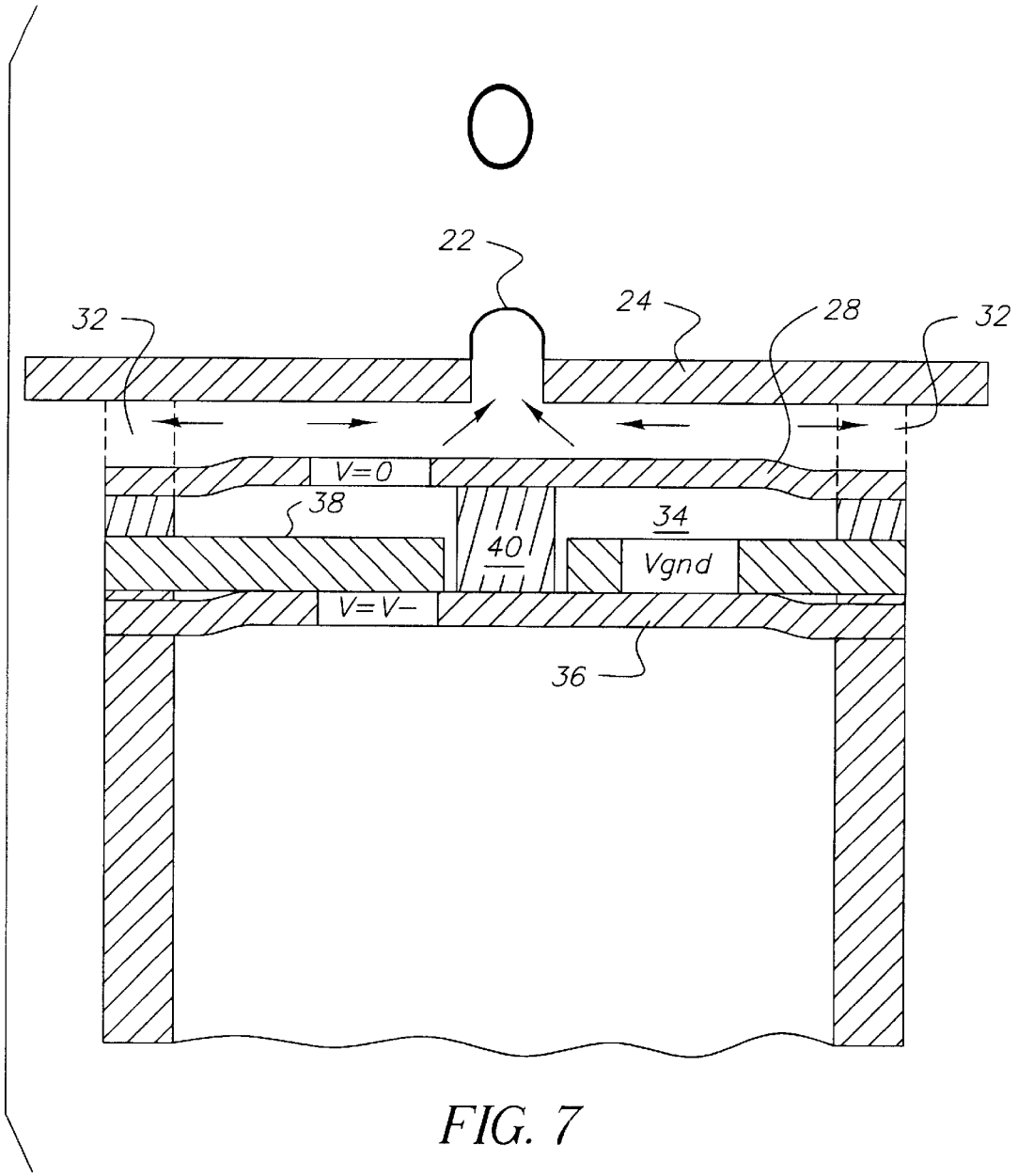
FIG. 7 is a cross-sectional view of the drop-on-demand liquid emission device of FIG. 2 shown in a second actuation stage.

Subsequently (say, several microseconds later) addressable electrode 28 is de-energized and addressable electrode 36 is energized, causing addressable electrode 36 to be pulled toward ground electrode 38 in conjunction with the release of the stored elastic potential energy. The timing of the de-energization of electrode 28 and the engization of electrode 36 may be simultaneous, or there may be a short dwell period therebetween so that the structure begins to move from the position illustrated in FIG. 6 toward the position illustrated in FIG. 7 under the sole force of stored elastic potential energy in the system. Still referring to FIG. 7, this action pressurizes the liquid in chamber 30 behind the nozzle orifice, causing a drop to be ejected from the nozzle orifice. To optimize both refill and drop ejection, ports 32 should be properly sized to present sufficiently low flow resistance so that filling of chamber 30 is not significantly impeded when electrode 28 is energized, and yet present sufficiently high resistance to the back flow of liquid through the port during drop ejection.

The center region of addressable electrode 36 is preferably structurally rigid so as to resist bending. In this manner, substantially all of the energy produced when it is addressed is transferred through coupler 40 to electrode 28. The central region of electrode 28 may also be rigid.

Referring to FIG. 2, the gap "A" between addressable electrode 28 and ground electrode 38 is large relative to gap "B" between addressable electrode 36 and ground electrode 38. Large gap "A" provides for sufficient movement of electrode 28 to load a large quantity of liquid into chamber 30 when an electrostatic charge is applied to addressable electrode 28 to pull that electrode toward ground electrode 38. By providing a small initial gap "B", electrode 36 does not travel too far from ground electrode 38 during the loading process to produce sufficient attractive force when an electrostatic charge is applied to addressable electrode 36. In fact, electrode 36 could initially be in actual contact with ground electrode 38, but this is not believed to be preferred since some movement beyond the position shown in FIG. 2 during drop ejection so that the return movement towards the rest position can be used to draw liquid into chamber 30.

Figure 8:
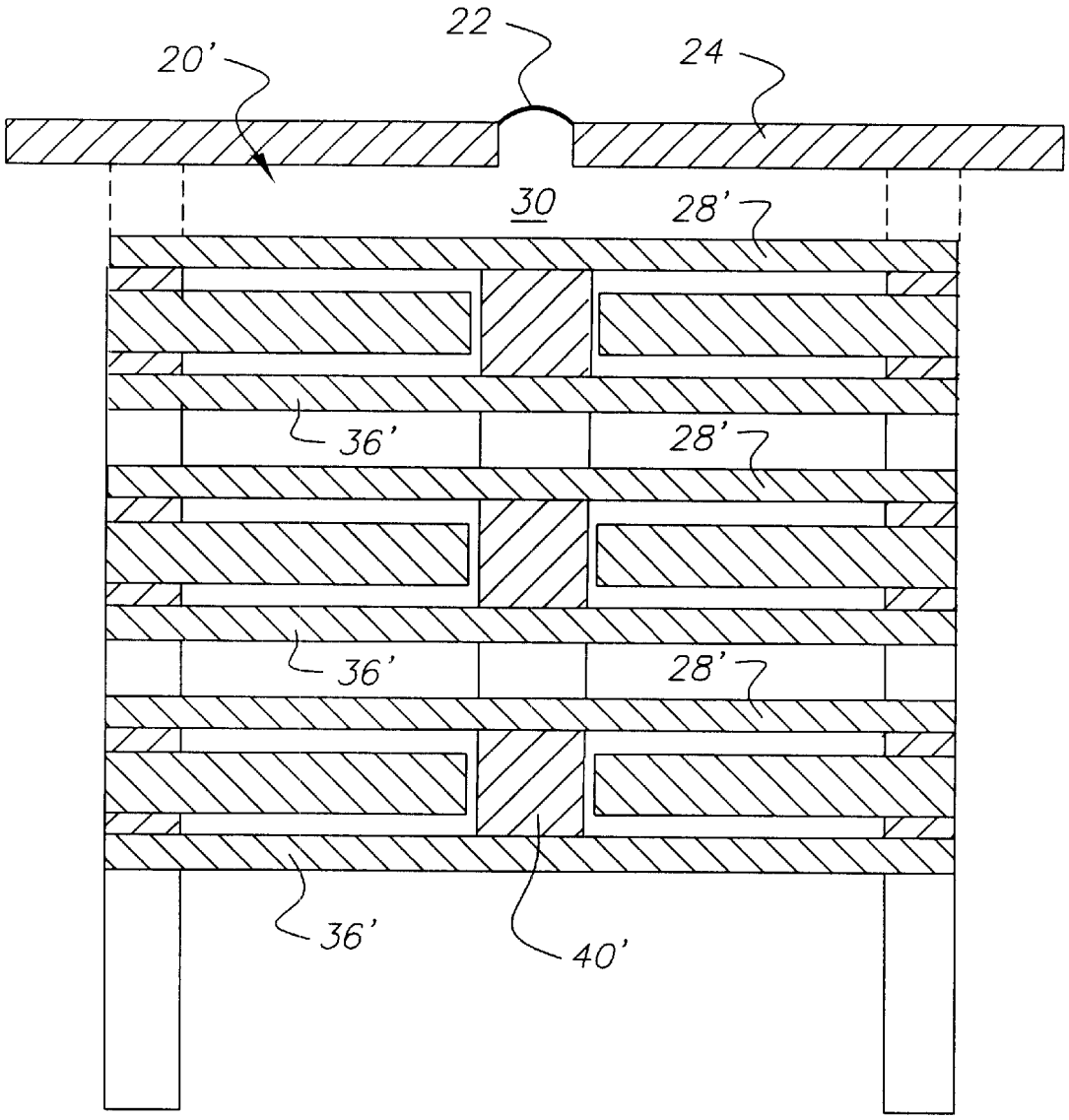
FIG. 8 is a cross-sectional view of a portion of another embodiment of the drop-on-demand liquid emission device of FIG. 1.

It is contemplated that each nozzle orifice 22 may be provided with a drop ejection mechanism 20' as illustrated in FIG. 8, wherein a plurality of electrode sets are attached to a single coupler 40' should additional ejection force be desired. Each electrode set includes an electrically-addressable electrode 28', but only the electrode 28' nearest to nozzle orifice 22 needs to be sealingly attached to wall 26 to define a liquid chamber 30. A second electrode 36' of each electrode set is electrically addressable separately from electrode 28'. A ground electrode 38' completes each electrode set. One or more of the electrode sets can be actuated at a time to provide an adjustable amount of drop ejection force.

The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

What is claimed is:

1. An emission device for ejecting a liquid drop, said device comprising:

a structure defining a chamber volume adapted to receive a liquid and having a nozzle orifice through which a drop of received liquid can be emitted;

an actuator having:

a first electrode associated with a movable wall portion of the chamber volume defining structure such that electrical actuation of the first electrode moves the movable wall portion in a direction to increase the chamber volume to draw liquid into the chamber volume, and a second electrode associated with the movable wall portion such that electrical actuation of the second electrode moves the movable wall portion in a direction to decrease the chamber volume to emit a liquid drop through the nozzle orifice; and a controller adapted to selectively electrically actuate the first and second electrodes.

2. An emission device for ejecting a liquid drop as defined in claim 1, wherein the moveable wall portion is disposed in the chamber volume defining structure in opposed alignment with the nozzle orifice.

3. An emission device for ejecting a liquid drop as defined in claim 1, wherein the moveable wall portion is circular in shape.

4. An emission device for ejecting a liquid drop as defined in claim 1, wherein the moveable wall portion is rectangular in shape.

5. An emission device for ejecting a liquid drop as defined in claim 1, wherein the emission device is a print head of an ink jet printing system.

6. A liquid drop emission device comprising:

a structure defining a chamber volume adapted to receive a liquid and having a nozzle orifice from which a drop of received liquid can be emitted;

an actuator having:

a first electrode pair associated with a movable wall portion of the chamber volume defining structure such that electrical actuation of the first electrode pair moves the movable wall portion in a direction to increase the chamber volume to draw liquid into the chamber volume;

a second electrode pair associated with the movable wall portion such that electrical actuation of the second electrode pair moves the movable wall portion in a direction to decrease the chamber volume to emit a liquid drop through the nozzle orifice; and a controller adapted to selectively electrically actuate the first and second electrode pairs.

7. A liquid drop emission device as set forth in claim 6 wherein the controller is adapted to de-actuate said first electrode pair before actuating said second electrode pair.

8. A liquid drop emission device as set forth in claim 7 wherein the controller is adapted not to actuate said second electrode pair until a short dwell period has passed after de-actuation of said first electrode pair.

9. A liquid drop emission device as set forth in claim 6 wherein the controller is adapted to simultaneously de-actuate said first electrode pair and actuate said second electrode pair.

10. A liquid drop emission device comprising:

a structure defining a chamber volume adapted to receive a liquid and having a nozzle orifice from which a drop of received liquid can be emitted; and an electrostatic actuator having:

a first member associated with a movable portion of the wall structure defining the chamber volume such that movement of the first member in a first direction increases the chamber volume;

a second member associated with a movable portion of the wall structure defining the chamber volume such that movement of the second member in a second direction decreases the chamber volume; and an electrode structure in opposition to the first and second movable members such that:

application of an electrostatic charge differential between the first moveable member and the electrode structure moves the first moveable member in said first direction to increase the chamber volume and application of an electrostatic charge differential between the second moveable member and the electrode structure moves the second moveable member in said second direction to decrease the chamber volume.

11. A liquid drop emission device as defined in claim 10 further comprising a controller having:

a first state applying an electrostatic charge differential between the first moveable member and the electrode structure; and a second state applying an electrostatic charge differential between the second moveable member and the electrode.

12. A drop-on-demand liquid drop emission device comprising:

a structure defining a chamber volume adapted to receive a liquid and having a nozzle orifice from which a drop of received liquid can be emitted; and an electrostatic drop ejection mechanism, the mechanism having:

a ground electrode;

a pair of structurally coupled, separately-addressable electrodes on opposite sides of the ground electrode such that the three electrodes are generally aligned with the nozzle orifice, said pair of addressable electrodes being movable in first and second directions, movement of the addressable electrodes in the first direction being effective to increase the chamber volume and movement of the addressable electrodes in the second direction being effective to decrease the chamber volume; and a controller adapted to selectively apply an electrostatic charge to one of the addressable electrodes such that:

a charge differential between the one addressable electrode and the ground electrode increases the chamber volume and a charge differential between the other addressable electrode and the ground electrode decreases the chamber volume.

13. A drop-on-demand liquid emission device as defined in claim 12 wherein the ground electrode is structurally stiff.

14. A drop-on-demand liquid emission device as defined in claim 12 wherein the addressable electrodes are structurally connected by a rigid coupler.

15. A drop-on-demand liquid emission device as defined in claim 14 wherein the coupler is electrically insulating.

16. A drop-on-demand liquid emission device as defined in claim 14 wherein the coupler is formed of a conductive material having a non-conductive break therein.

17. A drop-on-demand liquid emission device as defined in claim 12 wherein a center region of one of the addressable electrodes is structural rigid so as to resist bending.

18. A drop-on-demand liquid emission device as defined in claim 12 wherein a center region of both addressable electrodes is structural rigid so as to resist bending.

19. A drop-on-demand liquid emission device as defined in claim 12 wherein one of the addressable electrodes is closer to the ground electrode than is the other addressable electrode.

20. A drop-on-demand liquid emission device as defined in claim 19 wherein one of the addressable electrodes is further from the nozzle orifice than is the other addressable electrode.

21. A drop-on-demand liquid drop emission device comprising:

a structure defining a chamber volume adapted to receive a liquid and having a nozzle orifice from which a drop of received liquid can be emitted;

an electrostatic drop ejection mechanism, the mechanism having:

a plurality of ground electrodes;

a pair of structurally coupled, separately-addressable electrodes associated with and on opposite sides of each ground electrode such that the three electrodes are generally aligned with the nozzle orifice, said pairs of addressable electrodes being movable in first and second directions whereby movement of the addressable electrodes in the first direction is effective to increase the chamber volume and movement of the addressable electrodes in the second direction is effective to decrease the chamber volume; and a controller adapted to selectively apply an electrostatic charge to a first one of the pairs of addressable electrodes and to a second one of the pairs of addressable electrodes such that:

a charge differential between the first one of the pairs of addressable electrodes and the ground electrodes increases the chamber volume; and a charge differential between the second one of the pairs of addressable electrodes and the ground electrodes decreases the chamber volume.

* * * * *